US010559196B2

(12) United States Patent
Matus et al.

(10) Patent No.: US 10,559,196 B2
(45) Date of Patent: Feb. 11, 2020

(54) METHOD AND SYSTEM FOR VEHICULAR-RELATED COMMUNICATIONS

(71) Applicant: Zendrive, Inc., San Francisco, CA (US)

(72) Inventors: Jonathan A. Matus, San Francisco, CA (US); Pankaj Risbood, San Francisco, CA (US)

(73) Assignee: Zendrive, Inc., San Francisco, CA (US)

( * ) Notice: Subject to any disclaimer, the term of this patent is extended or adjusted under 35 U.S.C. 154(b) by 0 days.

(21) Appl. No.: 16/166,895

(22) Filed: Oct. 22, 2018

(65) Prior Publication Data

US 2019/0122543 A1 Apr. 25, 2019

Related U.S. Application Data

(60) Provisional application No. 62/575,126, filed on Oct. 20, 2017.

(51) Int. Cl.
*G08G 1/01* (2006.01)

(52) U.S. Cl.
CPC ..... *G08G 1/0133* (2013.01); *G08G 1/0112* (2013.01); *G08G 1/0141* (2013.01)

(58) Field of Classification Search
CPC ... G08G 1/0133; G08G 1/0112; G08G 1/0141
USPC ..... 701/117
See application file for complete search history.

(56) References Cited

U.S. PATENT DOCUMENTS 5,673,039 A 9/1997 Pietzsch et al.
6,049,778 A 4/2000 Walker et al.
6,055,477 A 4/2000 McBurney et al.
6,826,477 B2 11/2004 Ladetto et al.
6,941,222 B2 9/2005 Yano et al.
7,065,449 B2 6/2006 Brewster et al.
7,532,196 B2 5/2009 Hinckley
(Continued)

FOREIGN PATENT DOCUMENTS

DE 3439000 A1 4/1986
DE 102008008555 8/2008
(Continued)

OTHER PUBLICATIONS

Kalra, Nidhi, "Analyzing Driving and Road Events via Smartphone", International Journal of Computer Applications (0975-8887), vol. 98—No. 12, Jul. 2014, pp. 5-9.
(Continued)

*Primary Examiner* — Tuan C To

(74) *Attorney, Agent, or Firm* — Jeffrey Schox; Caitlin Ploch

(57) ABSTRACT

A method for improving vehicular traffic-related communications between devices including: collecting a first movement dataset corresponding to a sensor of a device arranged within a vehicle; collecting a supplementary dataset from the device; transmitting the movement dataset and supplementary dataset from the device to a remote computing system; determining a traffic-related event based upon processing the movement dataset and supplementary dataset with a traffic event model; and transmitting a traffic-related communication from the remote computing system to a second device associated with a second user arranged in a second vehicle.

19 Claims, 5 Drawing Sheets

(56) References Cited

U.S. PATENT DOCUMENTS 7,668,931 B2 2/2010 Parupudi et al.
7,801,675 B2 9/2010 Currie et al.
7,881,868 B2 2/2011 Greene et al.
8,054,168 B2 11/2011 McCormick et al.
8,264,375 B2 9/2012 Devries
8,326,257 B2 12/2012 Shiu et al.
8,352,189 B2 1/2013 Scott et al.
8,369,876 B2 2/2013 Bachmann et al.
8,395,542 B2 3/2013 Scherzinger et al.
8,489,330 B2 7/2013 Ellanti et al.
8,498,610 B2 7/2013 Staehlin
8,504,035 B2 8/2013 Shin et al.
8,521,193 B2 8/2013 Paek et al.
8,577,703 B2 11/2013 McClellan et al.
8,634,822 B2 1/2014 Silver et al.
8,754,766 B2 6/2014 Oesterling et al.
8,912,103 B2 12/2014 Heo et al.
8,971,927 B2 3/2015 Zhou et al.
8,972,103 B2 3/2015 Elwart et al.
8,996,234 B1 3/2015 Tamari et al.
9,064,412 B2 6/2015 Baur
9,121,940 B2 9/2015 Psiaki et al.
9,141,974 B2 9/2015 Jones et al.
9,185,526 B2 11/2015 Guba et al.
9,188,451 B2 11/2015 Magnusson et al.
9,221,428 B2 12/2015 Kote et al.
9,222,798 B2 12/2015 Curtis et al.
9,224,293 B2 * 12/2015 Taylor ..... G08G 1/08
9,250,090 B2 2/2016 Hille et al.
9,311,211 B2 4/2016 Chatterjee et al.
9,311,271 B2 4/2016 Wright
9,360,323 B2 6/2016 Grokop
9,368,027 B2 6/2016 Jang et al.
9,390,625 B2 7/2016 Green et al.
9,423,318 B2 8/2016 Liu et al.
9,467,515 B1 10/2016 Penilla et al.
9,495,601 B2 11/2016 Hansen
9,536,428 B1 1/2017 Wasserman
9,558,520 B2 1/2017 Peak et al.
9,566,981 B2 2/2017 Rebhan et al.
9,628,975 B1 4/2017 Watkins et al.
9,632,507 B1 4/2017 Korn
9,633,487 B2 4/2017 Wright
9,645,970 B2 5/2017 Boesch et al.
9,674,370 B2 6/2017 Kim et al.
9,689,698 B2 6/2017 Wesselius et al.
9,716,978 B2 7/2017 Sankaran
9,731,713 B2 8/2017 Horii
9,773,281 B1 9/2017 Hanson
9,794,729 B2 10/2017 Meyers et al.
9,800,716 B2 10/2017 Abramson et al.
9,801,027 B2 10/2017 Levy et al.
9,805,601 B1 10/2017 Fields et al.
9,818,239 B2 11/2017 Pal et al.
9,842,120 B1 12/2017 Siris et al.
9,852,475 B1 12/2017 Konrardy et al.
9,854,396 B2 12/2017 Himmelreich et al.
9,868,394 B1 1/2018 Fields et al.
9,870,649 B1 1/2018 Fields et al.
10,176,524 B1 * 1/2019 Brandmaier ..... G06Q 40/08
2002/0161517 A1 10/2002 Yano et al.
2003/0018430 A1 1/2003 Ladetto et al.
2004/0082311 A1 4/2004 Shiu et al.
2005/0080555 A1 4/2005 Parupudi et al.
2005/0093868 A1 5/2005 Hinckley
2005/0197773 A1 9/2005 Brewster et al.
2006/0153198 A1 7/2006 Chadha
2007/0005228 A1 1/2007 Sutardja
2007/0208494 A1 9/2007 Chapman et al.
2007/0208501 A1 9/2007 Downs et al.
2008/0033776 A1 2/2008 Marchese
2008/0103907 A1 5/2008 Maislos et al.
2008/0243439 A1 10/2008 Runkle et al.
2008/0312832 A1 12/2008 Greene et al.
2009/0024419 A1 1/2009 McClellan et al.
2010/0056175 A1 3/2010 Bachmann et al.
2010/0100398 A1 4/2010 Auker et al.
2010/0106406 A1 4/2010 Hille et al.
2010/0198517 A1 8/2010 Scott et al.
2010/0219944 A1 9/2010 Mc et al.
2010/0273508 A1 10/2010 Parata et al.
2010/0299021 A1 11/2010 Jalili
2011/0077028 A1 * 3/2011 Wilkes, III ..... B60W 50/14 455/456.3
2011/0124311 A1 5/2011 Staehlin
2011/0161116 A1 6/2011 Peak et al.
2011/0246156 A1 10/2011 Zecha et al.
2011/0294520 A1 12/2011 Zhou et al.
2012/0050095 A1 3/2012 Scherzinger et al.
2012/0065871 A1 * 3/2012 Deshpande ..... G08G 1/0112 701/118
2012/0066053 A1 3/2012 Agarwal
2012/0089328 A1 4/2012 Ellanti et al.
2012/0129545 A1 * 5/2012 Hodis ..... G01S 5/0257 455/456.1
2012/0136529 A1 5/2012 Curtis et al.
2012/0149400 A1 6/2012 Paek et al.
2012/0158820 A1 * 6/2012 Bai ..... G07C 5/008 709/202
2012/0197587 A1 8/2012 Luk et al.
2012/0226421 A1 9/2012 Kote et al.
2012/0245963 A1 9/2012 Peak et al.
2013/0006469 A1 * 1/2013 Green ..... G07C 5/008 701/36
2013/0041521 A1 2/2013 Basir et al.
2013/0052614 A1 2/2013 Mollicone et al.
2013/0069802 A1 3/2013 Foghel et al.
2013/0096731 A1 4/2013 Tamari et al.
2013/0124074 A1 5/2013 Horvitz et al.
2013/0130639 A1 5/2013 Oesterling et al.
2013/0211618 A1 8/2013 Iachini
2013/0302758 A1 11/2013 Wright
2013/0316737 A1 11/2013 Guba et al.
2013/0317860 A1 11/2013 Schumann
2013/0325517 A1 12/2013 Berg
2013/0332357 A1 12/2013 Green et al.
2013/0344856 A1 12/2013 Silver et al.
2014/0038640 A1 2/2014 Wesselius et al.
2014/0046896 A1 2/2014 Potter
2014/0081670 A1 3/2014 Lim et al.
2014/0188638 A1 7/2014 Jones
2014/0232592 A1 8/2014 Psiaki et al.
2014/0244150 A1 8/2014 Boesch et al.
2014/0244156 A1 8/2014 Magnusson et al.
2014/0288765 A1 9/2014 Elwart et al.
2014/0358394 A1 12/2014 Picciotti
2015/0025917 A1 1/2015 Stempora
2015/0084757 A1 3/2015 Annibale et al.
2015/0087264 A1 3/2015 Goyal
2015/0097703 A1 4/2015 Baur
2015/0229666 A1 8/2015 Foster et al.
2015/0233718 A1 8/2015 Grokop
2015/0246654 A1 9/2015 Tadic et al.
2015/0332407 A1 11/2015 Wilson et al.
2015/0334545 A1 11/2015 Maier et al.
2016/0033366 A1 2/2016 Liu et al.
2016/0042767 A1 2/2016 Araya et al.
2016/0048399 A1 2/2016 Shaw
2016/0059855 A1 3/2016 Rebhan et al.
2016/0068156 A1 3/2016 Horii
2016/0086285 A1 3/2016 Jordan et al.
2016/0150070 A1 * 5/2016 Goren ..... H04W 4/029 455/404.2
2016/0171521 A1 6/2016 Ramirez et al.
2016/0174049 A1 6/2016 Levy et al.
2016/0189442 A1 6/2016 Wright
2016/0225263 A1 8/2016 Salentiny et al.
2016/0232785 A1 8/2016 Wang
2016/0269852 A1 9/2016 Meyers et al.
2016/0272140 A1 9/2016 Kim et al.
2016/0282156 A1 9/2016 Ott et al.
2016/0325756 A1 11/2016 Cordova et al.
2016/0328893 A1 11/2016 Cordova et al.
2016/0339910 A1 11/2016 Jonasson et al.

(56) References Cited

U.S. PATENT DOCUMENTS

| | | | | |
|---|---|---|---|---|
| 2016/0358315 | A1* | 12/2016 | Zhou | G06T 3/4092 |
| 2016/0364983 | A1* | 12/2016 | Downs | G08G 1/0108 |
| 2016/0379310 | A1 | 12/2016 | Madigan et al. | |
| 2016/0379485 | A1 | 12/2016 | Anastassov et al. | |
| 2016/0381505 | A1 | 12/2016 | Sankaran | |
| 2017/0034656 | A1 | 2/2017 | Wang et al. | |
| 2017/0053461 | A1 | 2/2017 | Pal et al. | |
| 2017/0097243 | A1 | 4/2017 | Ricci | |
| 2017/0103342 | A1 | 4/2017 | Rajani et al. | |
| 2017/0103588 | A1 | 4/2017 | Rajani et al. | |
| 2017/0115125 | A1 | 4/2017 | Outwater et al. | |
| 2017/0126810 | A1 | 5/2017 | Kentley et al. | |
| 2017/0138737 | A1 | 5/2017 | Cordova et al. | |
| 2017/0164158 | A1 | 6/2017 | Watkins et al. | |
| 2017/0178416 | A1 | 6/2017 | Barreira Avegliano et al. | |
| 2017/0178422 | A1 | 6/2017 | Wright | |
| 2017/0178424 | A1 | 6/2017 | Wright | |
| 2017/0210323 | A1 | 7/2017 | Cordova et al. | |
| 2017/0211939 | A1 | 7/2017 | Cordova et al. | |
| 2017/0232963 | A1 | 8/2017 | Pal et al. | |
| 2017/0234689 | A1 | 8/2017 | Gibson et al. | |
| 2017/0279947 | A1 | 9/2017 | Rajakarunanayake et al. | |
| 2017/0289754 | A1 | 10/2017 | Anderson et al. | |
| 2017/0369055 | A1* | 12/2017 | Saigusa | G08G 1/096791 |
| 2017/0371608 | A1 | 12/2017 | Wasserman | |
| 2018/0061230 | A1* | 3/2018 | Madigan | G08G 1/095 |
| 2018/0090001 | A1* | 3/2018 | Fletcher | G08G 1/096775 |
| 2018/0154908 | A1 | 6/2018 | Chen | |
| 2018/0174446 | A1 | 6/2018 | Wang | |
| 2019/0007511 | A1 | 1/2019 | Rodriguez et al. | |
| 2019/0035266 | A1* | 1/2019 | Riess | G08G 1/0141 |

FOREIGN PATENT DOCUMENTS

| | | | |
|---|---|---|---|
| EP | 0534892 | A1 | 3/1993 |
| GB | 2492369 | B | 4/2014 |
| KR | 20130106106 | A | 9/2013 |
| WO | 2004085220 | | 10/2004 |

OTHER PUBLICATIONS

Das Tathagata; et al."PRISM: Platform for Remote Sensing using Smartphones," In. Proc. Mobisys '10, Jun. 15-18, 2010, San Francisco, USA, pp. 63-76.

Mohan Prashanth; et al. Nericell: Rich Monitoring of Road and Traffic Conditions using Mobile Smartphones, SenSys '08, Nov. 5-7, 2008, Raleigh, North Carolina.

Giuseppe, Guido , et al., "Using Smartphones As a Tool to Capture Road Traffic Attributes", University of Calabria, Department of Civil Engineering, via P.Bucci, 87036—Rende (CS) Italy, Applied Mechanics and Materials, vol. 432 (2013, Trans Tech Publications, Switzerland, pp. 513-519.

"International Search Report and Written Opinion of the ISA, dated Jan. 8, 2019, for application No. PCT/US18/56916.".

"International Search Report and Written Opinion of the ISA, dated Feb. 14, 2019, for application No. PCT/US18/62665.".

* cited by examiner

METHOD AND SYSTEM FOR VEHICULAR-RELATED COMMUNICATIONS

CROSS-REFERENCE TO RELATED APPLICATIONS

This application claims the benefit of U.S. Provisional Application Ser. No. 62/575,126, filed 20 Oct. 2017, which is incorporated herein in its entirety by this reference.

TECHNICAL FIELD

This invention relates generally to the vehicle monitoring field, and more specifically to a new and useful method and system for facilitating vehicular-related communications associated with multiple vehicles.

DESCRIPTION OF THE PREFERRED EMBODIMENTS

The following description of the preferred embodiments of the invention is not intended to limit the invention to these preferred embodiments, but rather to enable any person skilled in the art to make and use this invention.

1. Overview

Figure 1:
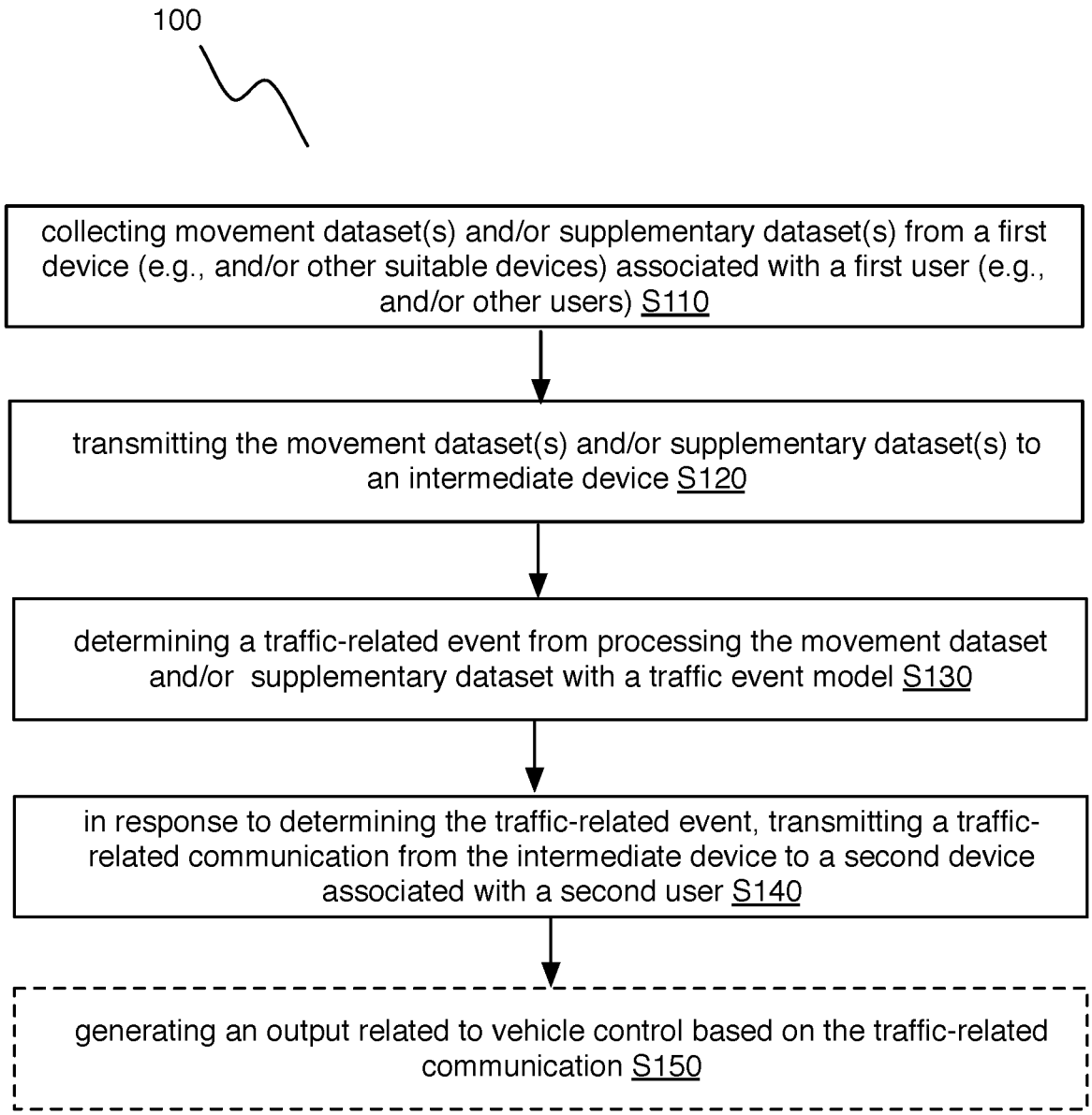
FIG. 1 is a flowchart representation of an embodiment of a method for inter-vehicle traffic-related communication.
Figure 2:
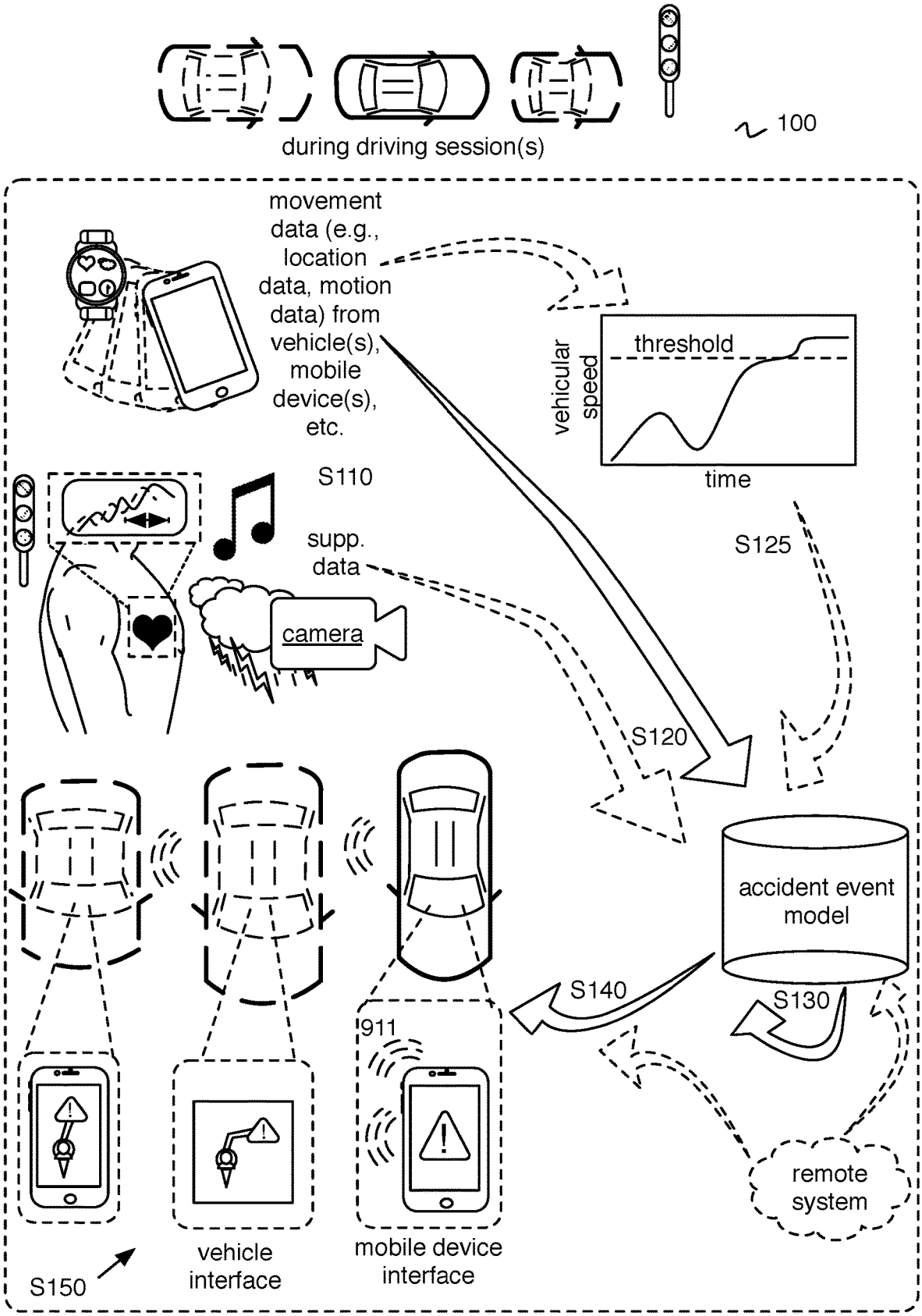
FIG. 2 is a schematic representation of an embodiment of the method for inter-vehicle traffic-related communication.

As shown in FIGS. 1-2, embodiments of a method 100 for improving vehicular traffic-related communications between devices (e.g., vehicles, smartphones, mobile devices proximal vehicles, etc.) can include: collecting a movement dataset (e.g., corresponding to at least one of a location sensor and a motion sensor; associated with position, velocity, and/or acceleration, "PVA", of a vehicle; etc.) and/or a supplementary dataset from a first device (e.g., a mobile device, an embedded in-vehicle device, and/or other suitable devices, etc.) associated with a first user (e.g., and/or other users) S110; transmitting the movement dataset and/or supplementary dataset from the first device to an intermediate device (e.g., a remote computing system, a mobile device, a network infrastructure node, etc.) S120; determining a traffic-related event from processing the movement dataset and/or supplementary dataset with a traffic event model S130; and in response to determining the traffic-related event, transmitting a traffic-related communication from the intermediate device to a second device associated with a second user S140.

The method 100 can optionally include generating an output related to vehicle control based on the traffic-related communication S150; and/or any other suitable blocks and/or subprocesses related to traffic-related communication between devices (e.g., arranged in separate vehicles).

Embodiments of the method 100 and/or system 200 can function to coordinate communications between devices (e.g., through a common coordination point of a remote computing system, through a mesh network including a plurality of mobile devices, a mesh network including a plurality of mobile devices in combination with fixed devices, etc.) associated with a plurality of users for detecting and appropriately responding to traffic-related events (e.g., in real time; in near real-time; within a time window greater than an average reaction time of a human driver to respond to an unexpected traffic situation such as a hard brake event, a swerve, etc.; any other suitable temporal characteristic; etc.). In a variation, detecting traffic-related events can include detecting a risk of a potential vehicular accident (e.g., based on vehicular actions performed by other proximal vehicles; based on high risk behavior of a driver of the vehicle associated with the first device, determined at the first device; based on sensor data indicating vehicular actions of proximal vehicles, such as smartphone sensor data for smartphones residing in the proximal vehicles, intersection sensor data; based on traffic data indicating a high frequency of accidents at a particular vehicular path; etc.), which can be responded to by transmitting appropriate traffic-related communications (e.g., notifications indicating that vehicles ahead on a vehicular path are slowing down; an alert indicating that an accident has occurred ahead on a vehicular path out of the sight line of the driver of the vehicle receiving the traffic-related communications; control instructions for autonomous or semi-autonomous vehicles to perform appropriate vehicular actions or driving maneuvers to reduce the risk of the potential vehicular accident; etc.).

Any suitable distribution of functionality can be implemented across components of the system 200 and/or components associated with the method 100. In an example, either a remote computing system or user devices can pre-process datasets (e.g., extract PVA data, movement data, location data, and any other suitable data; filter extracted data values to make downstream processing more efficient; etc.), and/or detect traffic-related events. In another example, the method and/or system can omit a remote computing system. In another example, Block S130 and/or S140 can be performed by any number of user devices (e.g., determining and/or responding to traffic-related events at a user smartphone, etc.).

In a specific example implementation, the functionality is distributed between a first mobile device, an intermediate device, and a second mobile device in order to minimize latency and maximize efficiency of data transmission and enhance the usefulness of the traffic-related communication. In this example, the first mobile device arranged within a first vehicle identifies an anomalous traffic situation based on the movement dataset and/or supplementary dataset and transmits the movement dataset and/or supplementary dataset to the intermediate device. The intermediate device determines what geographic region(s) and/or set of secondary devices (e.g., arranged within a geographic region) are likely to be affected (e.g., arranged in vehicles that are affected) by the anomalous traffic situation, and transmits a traffic-related communication to the determined set of secondary devices (e.g., the set of secondary devices within the determined geographic region). The receiving device (e.g., a second device to which the intermediate transmits the traffic-related communication) determines whether the received traffic-related communication is relevant to the traffic situation of the vehicle in which the second device is located; if it is relevant, the receiving device takes an appropriate action (e.g., generates control instructions; provides an alert or warning to the driver; automatically controls the vehicle or subsystems of the vehicle such as the brakes, steering, or any other suitable subsystems; etc.); and, if it is not relevant, the receiving device can do nothing (e.g., ignore the traffic-related communication), generate a labeled observation indicating that the traffic-related communication as a false positive (e.g., make a labeled observation for use in training or updating a traffic event model) and log the labeled observation, and/or take any other suitable action in response.

However, distribution of functionality across components of the system 100 and/or other suitable components can be configured in any suitable manner.

One or more instances of the method 100 and/or processes described herein can be performed asynchronously (e.g., sequentially), concurrently (e.g., in parallel, concurrently on different threads for parallel computing to improve system processing ability for determining a plurality of traffic-related events across a plurality of users substantially concurrently; for communicating traffic-related communications to a plurality of devices substantially concurrently, etc.), in temporal relation to a trigger event (e.g., detection of an traffic-related event, receipt of datasets at a remote computing system, etc.), and/or in any other suitable order at any suitable time and frequency by and/or using one or more instances of the system 200, elements, and/or entities described herein.

Additionally or alternatively, data described herein (e.g., movement data, supplementary data, traffic-related event determinations, etc.) can be associated with any suitable temporal indicators (e.g., seconds, minutes, hours, days, weeks, etc., temporal indicators such as time stamps indicating when the data was collected, determined and/or otherwise processed, temporal indicators providing context to content described by the data, such as temporal indicators indicating the time at which a vehicle exhibited the vehicle movement characteristics associated with an traffic-related event, etc.) and/or change in temporal indicators (e.g., PVA over time, data over time, change in data, data patterns, data trends, data extrapolation and/or other prediction, etc.). Additionally or alternatively, the method 100 can be performed in relation to events (e.g., traffic-related events, vehicle operation events, pedestrian events, weather events, etc.) additional to or alternative to traffic-related events. However, the method 100 and/or system 200 can be configured in any suitable manner.

2. Benefits

Variations of the technology can afford several benefits and/or advantages, in particular over conventional methodologies for improving traffic-related inter-vehicle communication.

First, the technology can leverage non-generic location data (e.g., location datasets, GPS data, beacon data, etc.) and/or motion data (e.g., motion datasets, accelerometer data, gyroscope data, etc.) to conveniently and unobtrusively determine a traffic-related event, and to automatically transmit communications about traffic-related events to users (e.g., by way of their mobile devices) who may be affected by the traffic-related event. In examples, the location data and/or motion data can be passively collected at a user's mobile computing device (e.g., a smartphone, a tablet, etc.), such that the technology can perform traffic event determination and/or receive traffic-related communications without requiring a user to purchase additional hardware (e.g., a specialized onboard device for monitoring traffic-related events, a purpose-built such device, etc.).

Second, the technology can provide advantages over manual crowd-sourced traffic-event determination and communication systems. For example, conventional systems enable drivers or other observers to report traffic events (e.g., accidents, speed traps, slowdowns, construction blockages, road debris, etc.) that have already occurred or are otherwise apparent. In contrast, variants of the technology can determine traffic-related events that are not yet visually apparent or have not necessarily yet caused an adverse result (e.g., a near-miss, a risky driving event, reckless or unskilled driving behavior, a hard braking event, a swerving event) and, by notifying relevant actors (e.g., drivers of nearby vehicles, drivers of vehicles that plan to be proximal the location of traffic-related event determination, users within a predetermined range of the traffic-related event as it occurs, etc.), prevent the occurrence of further or additional adverse traffic events (e.g., a rear-end accident that might otherwise occur as a result of a hard stop, a collision that might occur as a result of driving in close proximity to a reckless driver, etc.). Furthermore, variants of the technology can automatically detect and report traffic events (e.g., to devices in relevant contexts, such as those within a relevant range or predicted impact zone) without the need to manually (e.g., by a human driver, passenger, or other observer) determine and report such events.

Third, the technology can automatically initiate traffic-related actions in response to determination of traffic-related events and/or receipt of traffic-related communications. Traffic-related actions can include any one or more of controlling the user device, sending a notification to the user or a related entity, generating user-specific content, and/or other suitable user-related actions. Traffic-related actions can additionally or alternatively include controlling the vehicle or subsystems of the vehicle (e.g., brakes, throttle, signals, lights, steering, HVAC, audio-visual, etc.), generating control instructions (e.g., auditory instructions, visual instructions, etc.) for provision to a driver, and/or other suitable control-related actions. Further, in examples, the type of initiated traffic-related action can be tailored to the particular traffic-related communication or event based on movement data (e.g., motion data, location data, etc.) and/or supplemental data. In examples, the technology can include a software development kit for third-parties to integrate the traffic-related communication features into various applications, thereby enabling third-parties to leverage traffic-related event data that is automatically determined and communicated in relevant geographic areas for purposes of driving education, ride sharing, valet services, navigation, roadside assistance, insurance processing, emergency services, autonomous vehicle control, advanced driver assistance system operation, and/or other suitable services and applications.

Fourth, the technology can determine and communicate traffic-related event information in real-time (e.g., instantaneously, substantially real-time, near real-time, etc.). Prompt determination and inter-vehicle communication of traffic-related events (e.g., traffic slowdowns, accidents, near-accidents, etc.) can enable timely response (e.g. during the in-trip time period) to relevant events (e.g., a hard braking event ahead of but out of sight of the vehicle receiving the communication, a speeding vehicle approaching an intersection being approached by the vehicle receiving the communication at a speed too great to avoid entering the intersection against a red light, etc.) by the receiving entity (e.g., a driver, a user, an autonomous agent, etc.). In examples, the method can provide traffic-related notifications with a total end-to-end elapsed time of about 0.75-1.5 seconds between event onset and receipt of the communication at a device in a vehicle 100 to 300 meters behind the location of event occurrence, which can add to the reaction time margin of the driver of the vehicle (e.g., in addition to an average reaction time to human-perceived events on the order of hundreds of milliseconds).

Fifth, the technology can improve the technical fields of at least vehicle telematics, inter-vehicle networked communication, computational modeling of traffic-related events, and traffic-related event determination with mobile computing device data. The technology can continuously collect and utilize non-generic sensor data (e.g., location sensor data, motion sensor data, GPS data, audio/visual data, ambient light data, etc.) to provide real-time determination of traffic-related events and communication of those events to potentially affected entities. Further, the technology can take advantage of the non-generic sensor data and/or supplemental data (e.g., vehicle sensor data, weather data, traffic data, environmental data, biosignal sensor data, etc.) to better improve the understanding of correlations between such data and traffic-related events and/or responses to such events, leading to an increased understanding of variables affecting user behavior while driving and/or riding in a vehicle and/or traffic behavior at the scale of a population of users driving vehicles.

Sixth, the technology can provide technical solutions necessarily rooted in computer technology (e.g., utilizing computational models to determine traffic-related events from non-generic movement datasets and/or supplementary datasets collected at mobile computing devices, updating the computational models based on event determination and/or communication accuracy, etc.) to overcome issues specifically arising with computer technology (e.g., issues surrounding how to leverage movement data collected by a mobile computing device to determine traffic-related events, how to automatically communicate traffic-related information to initiate traffic-related actions for responding to traffic-related characterization, etc.).

Seventh, the technology can leverage specialized computing devices (e.g., computing devices with GPS location capabilities, computing devices with motion sensor functionality, wireless network infrastructure nodes capable of performing edge computation, etc.) to collect specialized datasets for characterizing traffic behaviors executed by the vehicle (e.g., under the influence of the driver's control, when controlled by an autonomous control system, etc.).

Eighth, the technology can enable prompt collision detection (e.g., substantially as described in U.S. application Ser. No. 15/727,972, filed 9 Oct. 2017, which is incorporated herein in its entirety by this reference), and communication of the collision to potentially affected vehicles by transmitting a traffic-related communication to mobile devices within those vehicles.

However, variations of the technology can offer any other suitable benefits and/or advantages.

3.1 Collecting Movement Datasets and/or Supplementary Datasets.

As shown in FIGS. 1-2, Block S110 can include collecting a movement dataset (e.g., corresponding to at least one of a location sensor and a motion sensor) and/or a supplementary dataset from a first device (e.g., smartphone) associated with a first user. Block S110 can function to collect traffic-related data for use in characterizing one or more traffic-related events. Movement datasets preferably describe at least one or more of position, velocity, and/or acceleration (PVA) of one or more vehicles (e.g., motor vehicles, bicycles, watercraft, aircraft, spacecraft, railed vehicles, autonomous vehicles, etc.), other user devices (e.g., smartphones, laptops, tablets, smart watches, smart glasses, virtual reality devices, augmented reality devices, aerial devices such as drones, medical devices, etc.), users (e.g., a vehicle driver, vehicle passenger, pedestrian, etc.). Movement dataset can additionally or alternatively describe any suitable movement-related characteristic.

Related to Block S110, supplementary datasets can include any one or more of: user data (e.g., indicative of user information describing one or more characteristics of one or more users and/or associated devices, etc.), audio data (e.g., audio recorded by a plurality of mobile devices, audio associated with a phone call, associated with conversations involving one or more users in a vehicle, which can indicate the number of users present in a vehicle, including content informative of one or more user characteristics, such as driver behavior in response to a traffic-related event, traffic-heavy route, environmental audio, vehicular audio, such as engine audio, etc.), optical data (e.g., optical datasets capturing traffic-related events; optical data capturing vehicular movements of proximal vehicles; optical data capturing the same object across different optical data from different mobile devices, imagery; video; internal vehicle-facing optical data of users and/or corresponding locations within a vehicle, such as optical data capturing a plurality of mobile devices and/or users within the vehicle; external vehicle-facing optical data of route, other users, other devices, landmarks, geographical markers; optical data capturing users entering or exiting the vehicle, such as from the driver side or passenger side; mobile device camera data; etc.), vehicle data (e.g., vehicle proximity sensor data, OBD data, vehicle operation data, vehicle camera data, PVA data, fuel data, motion sensor data, etc.), traffic data (e.g., route data, type of vehicular path such as freeway road or local road, which can be correlated with historic traffic-related events, user driving preferences, accident data, traffic level, traffic laws, etc.), biometric data (e.g., cardiovascular parameters, such as heart rate, which can be indicative of traffic-related events, of user driving behavior in response to different traffic conditions, sleep metrics, respiration data, biological fluid data, etc.), environmental data (e.g., weather conditions, which can be indicative of risk of vehicular accidents; which can be correlated with frequency of a particular user to operate a vehicle during such weather conditions, road conditions, pressure conditions, air quality, etc.), and/or any other suitable data for facilitating determination of traffic-related events, responding to traffic-related events, and/or for performing other portions of the method 100.

Supplementary datasets can be used to corroborate the determination of a traffic-related event (e.g., using audio data to recognize that a collision identified via a movement dataset has indeed occurred based on cabin noise exceeding a volume threshold, detection of an audible signature of a collision, etc.) and/or contradict the determination of a traffic-related event (e.g., using external imagery to recognize that what was identified as a risky swerve event was in fact a normal lane change). Corroboration can be performed on the primary device (e.g., first device, mobile device executing a variation of Block S110, etc.) and/or the intermediate device (e.g., at a 5G-enabled cellular tower that can perform computations at the tower itself, a centralized remote computing system, etc.).

In relation to Block S110, movement datasets and/or supplementary datasets can be collected at (e.g., sampled at, etc.) one or more of: motion sensors (e.g., multi-axis and/or single-axis accelerometers, gyroscopes, etc.), location sensors (e.g., GPS data collection components, magnetometer, compass, altimeter, etc.), optical sensors, audio sensors, electromagnetic (EM)-related sensors (e.g., radar, lidar, sonar, ultrasound, infrared radiation, magnetic positioning, etc.), environmental sensors (e.g., temperature sensors, altitude sensors, pressure sensors, etc.), biometric sensors, and/or any other suitable sensors and/or any other suitable data collection components associated with any suitable entities.

Regarding Block S110, data collection components can be associated with (e.g., provided by, included in, proximal, communicatively coupled with, etc.) one or more of: user devices, vehicular path-associated components (e.g., freeway roads, local roads, intersections, traffic lights, traffic signs, traffic markings, etc.), telecommunications entities (e.g., 3G, 4G, 4G-LTE, or 5G cellular towers; satellites; etc.), third party components, other suitable data collection components (e.g., motion sensors associated with location sensors due to being integrated in the same user device; etc.), and/or any other suitable components. In an example, data collection components can include microphones and/or cameras at intersections (e.g., for collecting supplementary datasets contextualizing or corroborating movement data collected at user devices traveling within vehicles at the intersection; for collecting optical and/or audio datasets that can be processed into movement features for describing PVA of vehicles at the intersection; etc.). In another example, data collection components can include sensors (e.g., motion sensors, location sensors, optical sensors, audio sensors, etc.) of user mobile devices. In another example, data collection components associated with a user can include data collection components geographically associated with the user (e.g., proximal the user's location), handled by the user (e.g., owned by the user, provided by the user, etc.), communicatively associated with the user (e.g., in communication with the user and/or devices associated with the user, etc.), and/or otherwise associated with the user. However, data collection components can be associated with any suitable entities in any suitable manner.

Relating to Block S110, movement datasets, supplementary datasets, and/or any other suitable traffic-related datasets can be collected from any suitable number of data collection components associated with any suitable number of users (e.g., drivers, passengers, pedestrians, observers, light-vehicle users, fleet managers, etc.), third parties (e.g., government entities, telecommunications entities, etc.), and/or other entities. In a specific example, user smartphone data, government intersection camera data, and third-party traffic data (e.g., an automated programming interface/API for retrieving traffic conditions) can be collected. Datasets collected from a plurality of sources are preferably processed in combination (e.g., used for inputs into a traffic event model; stored in association with each other, such as stored in association with a user identifier and/or driving session identifier; retrieved with each other; used in combination for feature extraction, such as for determining PVA features for a driving session; etc.) according to one or more data processing conditions.

In a variation of Block S110, data processing conditions can include temporal conditions. For example, datasets collected from a plurality of devices within a time period (e.g., 30 second window) can be processed together. In another example, datasets (e.g., different types of datasets sampled from different types of sensors; etc.) collected from a single device within a time period are processed together. In another example, datasets are collected from a second device in response to (e.g., subsequent to) collection at a first device and transmission from the first device to the second device (e.g., with intermediate processing and/or communication relaying).

In another variation of Block S110, data processing conditions can include location conditions. In an example, datasets within a geographic radius are processed together (e.g., processing datasets together from devices within a geographical radius of an intersection, of each other, of other suitable references, etc.). In another example, Block S110 can include serially collecting datasets based on a location condition. In a specific example, the method 100 can include determining an traffic-related event (e.g., an initial detection of a vehicular accident) based on a first movement dataset collected for a first vehicle (e.g., where the first vehicle is involved in vehicular accident); in response to determining the traffic-related event, collecting a second movement dataset from a second vehicle locationally proximal the first vehicle (e.g., within a predetermined threshold radius; where the second vehicle is passing the first vehicle involved in the vehicular accident, etc.); and confirming the traffic-related event (e.g., a confirmation of the vehicular accident, where emergency services can be contacted in response to the confirmation, etc.) based on the second movement dataset. In another example, Block S110 includes collecting a supplementary dataset that includes traffic data associated with a geographic location determined from the movement dataset gathered at a vehicle (e.g., a device inside the vehicle). However, performing multiple instances of Block S110 (e.g., serially, concurrently, etc.) and/or other suitable portions of the method 100 can be performed in any suitable manner (e.g., based on any suitable data processing conditions; without using data processing conditions; etc.).

In another variation of Block S110, data processing conditions can include network conditions. For example, datasets associated with a particular cellular network type (e.g., sampled at devices operating on the particular cellular network) can be processed together (e.g., for processing on a cellular tower associated with the cellular network type or operator). In another example, datasets can be collected when network quality (e.g., connectivity, packet loss rates, etc.) is above a threshold quality (e.g., to improve data integrity, to increase power efficiency of the collecting device, etc.).

In another variation of Block S110, data processing conditions can include data collection component conditions. For example, a first set of datasets sampled at a first data collection component can be processed together (e.g., pre-processed together at the first data collection component, such as at a first user smartphone; etc.); and a second set of datasets sampled at a second data collection component can be processed together (e.g., pre-processed together at a second user smartphone; etc.), such as prior to transmission of the pre-processed datasets to a remote computing system (e.g., for performance of Blocks S130, S140, etc.) from the first and the second data collection components, respectively.

Relating to Block S110, additionally or alternatively, collected datasets can be processed serially (e.g., a first movement dataset used in a first traffic event model; a second movement dataset and a supplementary dataset used in a second traffic event model; etc.), and/or in any suitable order and/or combination. Alternatively, collected datasets can be processed without reference to data processing conditions. However, data processing for traffic-related datasets based on data processing conditions can be performed in any suitable manner, and/or data processing can be otherwise performed.

Block S110 can be performed at predetermined time intervals (e.g., collecting datasets from smartphones every 15 seconds; collecting vehicle sensor data every minute from connected vehicles, from third parties such as OEM platforms, vehicle data databases; etc.), in response to and/or concurrently with a trigger event (e.g., receiving an traffic-related communication from another device; detecting conditions indicating a risk of an traffic-related event, such as a proximal position of a driver associated with a poor driver score; determining traffic-related events; performing of other suitable portions of the method 100; etc.) and/or at any other suitable frequency or time in any suitable temporal relationship to other portions of the method 100. Block S110 preferably includes performing low latency computations on the device to enable high frequency operations (e.g., near-real time) to improve the usefulness of the traffic-related information to secondary devices (e.g., receiving devices that receive traffic-related communications from an intermediate device).

In a variation, Block S110 can include differentially collecting traffic-related datasets (e.g., collecting different types of datasets, at different rates and/or times, using different data processing conditions, etc.), which can function to satisfy privacy preferences, improve battery life, selectively and dynamically escalate or deescalate data collection based on contextual situation (e.g., risk, driver, traffic conditions, determined traffic-related events; where such escalation or de-escalation can confer technologically-rooted improvements to the device functionality in facilitating traffic-related event determination and response; etc.). Differentially collecting traffic-related datasets can be based on: user preferences (e.g., collecting only movement datasets for a first user; collecting movement datasets and supplementary datasets for a second user; etc.), battery conditions (e.g., restricting sensor usage, such as sampling rate and/or types of vehicle sensors used, in response to a state-of-charge below a threshold; battery conditions for vehicles, smartphones, other suitable data collection components; etc.), network conditions (e.g., activating supplementary dataset collection in response to detecting strong cellular network signal strength or other network quality metrics; etc.), location conditions (e.g., activating additional dataset collection at a data collection component corresponding to a user location proximal a traffic sign associated with a high frequency of accidents or other types of traffic-related events, etc.), and/or any other suitable conditions, but differentially collecting traffic-related datasets can be performed in any suitable manner.

In another variation, Block S110 can include incentivizing users to permit collection of traffic-related data (e.g., through privacy permissions, through inputting traffic-related data such as data indicating characterizations of vehicular accidents, etc.), such as through: monetary incentives (e.g., currency transfers, credit transfers, cryptographic currency generation or transfers, etc.), digital incentives (e.g., avatars, images, badges, video, etc.), and/or other suitable incentives.

Additionally or alternatively, collecting movement datasets, supplementary datasets, and/or other suitable datasets can be performed in any manner included in and/or analogous to U.S. application Ser. No. 15/584,375 filed 2 May 2017, which is incorporated in its entirety by this reference. However, Block S110 can be performed in any suitable manner.

3.2 Transmitting Movement Datasets and/or Supplementary Datasets.

As shown in FIG. 1-2, Block S120 can include transmitting the movement dataset and/or supplementary dataset from a first device to an intermediate device (e.g., from a smartphone to a component of a telecommunications entity such as a telecommunications tower, cellular network node, etc.; from a smartphone to a remote server system; from a smartphone to another smartphone; etc.). Block S120 can function to transmit datasets to a processing entity for characterization of and/or response to traffic-related events. Additionally or alternatively, Block S120 can function to facilitate the aggregation of a plurality of traffic-related datasets sourced from a plurality of sources (e.g., associated with multiple users and/or vehicles) at a central processing entity for improving storage, retrieval, analysis, and/or other suitable processing in determining and/or responding to traffic-related events. In variations wherein the intermediate device is a remote computing system, remote computing systems can include one or more of: telecommunications entities (e.g., telecommunications towers), remote servers, remote networked computing system, stateless computing system, stateful computing system, satellites, and/or any other suitable computing systems. In a specific example, the intermediate device includes a network infrastructure component (e.g., cellular telephone tower or node) defining a fixed geographic location within a predetermined range of the first device (e.g., cellularly or otherwise wirelessly connected to the first device, within the network cell corresponding to the first device, etc.). In another specific example, the intermediate device includes a second device substantially similar to the first device (e.g., a mobile phone, a smartphone, a mobile device, etc.) communicatively connected to the first device (e.g., as a mesh network component).

Relating to Block S120, transmitting datasets can include transmitting: raw traffic-related datasets (e.g., movement datasets, supplementary datasets, etc.), processed traffic-related datasets (e.g., extracted movement features, supplementary features, etc.). Feature extraction and/or other suitable processing operations can be performed at the corresponding data collection component (e.g., the device that sampled the data), at intermediary devices, and/or at any other suitable components. Transmitting datasets can include transmitting from any number of devices, any amount and types of data, and/or transmission by devices at any suitable time in relation to each other.

Regarding Block S120, datasets are preferably transmitted from the device that sampled the data (e.g., to reduce latency associated with transmitting datasets to the traffic-related event characterization system, such as the remote computing system, a mesh-network connected device, etc.). Additionally or alternatively the movement dataset can be transmitted indirectly from a device that sampled the data to the remote computing system (e.g., through an intermediary device) and/or any other suitable device. In an example, a movement dataset collected at a vehicle can be transmitted to a user smartphone residing in the vehicle (e.g., through a wired connection), and from the user smartphone to a cellular tower and/or other suitable remote computing systems for subsequent processing. In another, a movement dataset collected at the vehicle by a user smartphone residing in the vehicle can be transmitted to a second user smartphone in another vehicle (e.g., a nearby vehicle), and from the second user smartphone to a cellular tower and/or other suitable intermediate device for subsequent processing. However, any suitable data (e.g., collected in Block S110) can be transferred between any suitable components in any suitable order at any suitable time and/or frequency.

In variations, Block S120 can be performed in response to a trigger event. The trigger event can include a movement parameter (e.g., extracted from the movement dataset) exceeding a threshold. For example, Block S120 can include transmitting a movement dataset to a remote computing system in response to an acceleration of the vehicle exceeding a threshold value (e.g., wherein the threshold is computed at collecting device based on a vehicle speed, speed in combination with traffic data, etc.). The threshold can be predetermined (e.g., set at a fixed threshold speed value, acceleration or deceleration value, etc.), dynamically determined (e.g., based on local traffic congestion conditions retrieved periodically from a real-time database, estimated based on PVA data, etc.), contextually determined (e.g., based on the roadway type, intersection location and/or properties, etc.), and/or otherwise suitably determined.

However, Block S120 can be otherwise suitably performed in any suitable manner.

3.2.A Selecting Traffic-Related Data to Transmit.

As shown in FIG. 2, Block S120 can additionally or alternatively include selecting traffic-related data from the movement datasets and/or supplementary datasets to transmit S125. Block S125 can function to filter, pre-process, and/or otherwise select relevant data for transmission. Additionally or alternatively, S125 can function to reduce latency (e.g., between the occurrence of a vehicular accident and the detection of a corresponding traffic-related event; etc.), improve battery conditions (e.g., save battery life), and/or confer other suitable improvements to system components and/or components associated with the method 100.

Relating to Block S125, selecting traffic-related data preferably includes selecting a subset of data (e.g., including any suitable data types, data size, corresponding data collection components, associated entities; etc.) for transmission. Alternatively, selecting traffic-related data can include selecting the entirety of sampled traffic-related data to transmit (e.g., in response to detecting an upcoming intersection associated with a high frequency of vehicular accidents; etc.). However, any suitable data can be selected.

Regarding Block S125, selecting traffic-related data for transmission can be based on one or more of: data types (e.g., only transmitting location sensor data rather than additional supplementary data from the same device in response to detecting stored supplementary data from a different proximal device, only transmitting motion sensor data based on local motion characteristics matching a predetermined pattern indicative of a sudden stop or swerve to which location data is irrelevant, etc.), device type (e.g., selecting a first movement dataset sampled at a first user device with updated sensors, versus a second movement dataset at a second user device with older sensor versions, where the first and the second user devices reside in the same vehicle and/or are otherwise associated; etc.), temporal conditions (e.g., only transmit data sampled within the past 30 seconds, etc.), traffic-related events (e.g., selecting additional data types to transmit in response to detecting poor driver scores associated with proximal drivers; determining the types and amount of data to transmit based on historic traffic-related events associated with conditions matching and/or similar to current driving conditions, etc.), environmental conditions (e.g., weather, road conditions, etc.) and/or any other suitable characteristics.

Relating to Block S125, traffic-related data is preferably selected at the data collection components at which the movement datasets and/or supplementary datasets are sampled. Additionally or alternatively, traffic-related data can be selected at intermediary devices (e.g., a device in the communication flow between the data collection device and the remote computing system). However, Block S125 can be performed in any suitable manner.

3.3 Determining a Traffic-Related Event.

As shown in FIGS. 1-2, Block S130 can include determining a traffic-related event from processing the movement dataset and/or supplementary dataset with a traffic event model. Block S130 can function to detect, predict, and/or otherwise determine traffic-related events for facilitating initiation of appropriate traffic-related responses (e.g., traffic-related communications), such as in real-time. Traffic-related events can include accident related events, such as: occurrence of a vehicular accident, prediction of a future vehicular accident, indications of historic vehicular accidents (e.g., associated with a proximal driver, associated with a proximal vehicular path component, etc.), risk of vehicular accidents (e.g., risk score; etc.), parameters associated with accident related events (e.g., timing, users involved, vehicles involved, type of vehicular accident, severity, etc.) and/or any other suitable characterizations of vehicular accidents. Vehicular accidents related to traffic-related events can include: collisions (e.g., single-vehicle collisions, multi-vehicle collisions, pedestrian collisions, etc.), vehicle failures (e.g., mechanical breakdowns, electrical failures, software failures, issues with battery, wheel change, fuel, puncture, charging, clutch, ignition, cooling, heating, ventilation, brakes, engine, etc.), and/or any other suitable type of vehicular accident. Traffic-related events can also include vehicle events that are accident adjacent (e.g., can increase the likelihood of an accident occurring) or unrelated to a collision or accident, such as: hard braking events (e.g., deceleration/acceleration above or below a threshold value designating hard braking), swerving (e.g., horizontal acceleration above a threshold value, lateral motion above a threshold value, etc.), moving violations (e.g., entering an intersection against the prevailing traffic signal, running a stop sign, speeding, etc.), and/or any other suitable type of traffic-related event. In examples, determining a traffic-related event can include determining that a user has violated a traffic rule, law, or regulation, substantially as described in U.S. application Ser. No. 16/022,184, filed 28 Jun. 2018, which is incorporated herein in its entirety by this reference. However, traffic-related events can additionally or alternatively include any other suitable events related to vehicular operations.

Block S130 is preferably performed by an intermediate device (e.g., a device other than the first device, a remote computing system, another device on a mesh network connected to the first device, etc.) but can additionally or alternatively be performed by the first device (e.g., the transmitting device) or second device (e.g., receiving device downstream of the intermediate device), and/or any other suitable device.

Block S130 preferably includes determining traffic-related events based on movement data (e.g., PVA characteristics and/or PVA-related data; extracted movement features; movement data from a single device, such as a single smartphone residing in the vehicle; movement data from a plurality of devices associated with different entities; movement data from any suitable sources; etc.). In another example, traffic-related events can be based on a plurality of movement data (and/or other supplementary data) collected from different devices within a location radius (and/or other suitable location parameter) of a reference location (e.g., location of a central device associated with a vehicle involved in the vehicular accident; location of an intersection; location of a device; determined based on location sensor data; a triangulated location based on movement data and/or supplementary data from multiple sources proximal the vehicular accident; etc.). In a specific example, a risk of a potential vehicular accident can be detected based on vehicular actions performed by proximal vehicles within a radius, such as a 0.1-mile radius (e.g., recommending a lane change based on proximal vehicles performing the lane change; recommending a speed decrease based on proximal vehicles decreasing speed beyond a threshold; etc.). In another example, traffic-related events can be based on movement data (and/or supplementary data) collected within a threshold time period (e.g. where a traffic event model is executed at predetermined time intervals using input data collected during a current and/or preceding time interval, etc.). In another example, traffic-related events can be based on movement data collected from a plurality of devices associated with any suitable number of remote computing systems, such as telecommunications networks and/or entities (e.g., where a single or a plurality of remote computing systems can perform processes associated with Block S130 and/or other suitable portions of the method 100, etc.). In a specific example, for a vehicular accident involving a first and a second vehicle (e.g., in communication with one or more remote computing systems, etc.), Block S130 can include determining an traffic-related event based on first movement data describing movement of the first vehicle (e.g., collected at a smartphone residing in the first vehicle; an abrupt decrease in acceleration of a magnitude exceeding a threshold change in acceleration and indicating a moving vehicle colliding into an object; etc.), and on second movement data describing movement of the second vehicle (e.g., collected at a smartphone residing in the second vehicle; an abrupt increase in acceleration indicating a stopped vehicle that was collided into by a moving vehicle; etc.). However, determining traffic-related events based on movement data can be performed in any suitable manner.

Additionally or alternatively, Block S130 can include determining traffic-related events based on supplementary data. For example, Block S130 can include: detecting a vehicular accident based on movement datasets (e.g., PVA data associated with the vehicles involved in the vehicular accident, etc.); and confirming the occurrence of the detected vehicular accident based on supplementary data (e.g., audio data including sirens of emergency services tending to the vehicular accident; camera data capturing the vehicular accident, such as camera data captured at vehicular paths such as highways; traffic data describing a spike in traffic proximal the vehicular accident; etc.). In another example, Block S130 can include detecting a traffic-related event based on supplementary sensor data collected from vehicular path-associated components (e.g., optical data, audio data, motion data, from sensors proximal freeway roads, local roads, intersections, traffic lights, traffic signs, etc.). However, determining traffic-related events based on supplementary data can be performed in any suitable manner.

In a variation, Block S130 can include extracting one or more movement features and/or supplementary features (e.g., from movement data and/or supplementary data, etc.), such as in any manner analogous to that described in U.S. application Ser. No. 15/584,375, filed 2 May 2017, which is incorporated herein in its entirety by this reference. Additionally or alternatively, processing traffic-related data in relation to Block S130 and/or other suitable portions of the method 100 can include any one or more of: performing pattern recognition on data (e.g., detecting PVA patterns and correlating to traffic-related events; etc.), fusing data from multiple sources (e.g., multiple devices, multiple data collection components, data across multiple temporal indicators, etc.), combination of values (e.g., averaging values, etc.), compression, conversion (e.g., digital-to-analog conversion, analog-to-digital conversion), performing statistical estimation on data (e.g. ordinary least squares regression, non-negative least squares regression, principal components analysis, ridge regression, etc.), wave modulation, normalization, updating, ranking, weighting, validating, filtering (e.g., for baseline correction in relation to vehicle-related movement versus user-related movement of devices residing within a vehicle; data cropping, etc.), noise reduction, smoothing, filling (e.g., gap filling), aligning, model fitting, binning, windowing, clipping, transformations, mathematical operations (e.g., derivatives, moving averages, summing, subtracting, multiplying, dividing, etc.), data association, multiplexing, demultiplexing, interpolating, extrapolating, clustering, image processing techniques (e.g., for optical data, image filtering, image transformations, histograms, structural analysis, shape analysis, object tracking, motion analysis, feature detection, object detection, stitching, thresholding, image adjustments, etc.), other signal processing operations, other image processing operations, visualizing, and/or any other suitable processing operations. However, extracting features and/or processing traffic-related datasets can be performed in any suitable manner.

In another variation, Block S130 (e.g., traffic event models of Block S130) and/or other portions of the method 100 can employ approaches including any one or more of: classification (e.g., for presence of a traffic-related event; for different types of traffic-related events; etc.), decision-trees (e.g., for characterizing traffic-related events; for determining satisfaction of conditions triggering monitoring for traffic-related events; etc.), regression (e.g., for determining driving recommendations; for predicting vehicular outcomes associated with driving recommendations; etc.), neural networks (e.g., convolutional neural networks for processing optical data captured by devices associated with driving sessions; etc.), heuristics, equations (e.g., weighted equations, such as for weighing features associated with a plurality of data collection components; etc.), selection (e.g., of a subset of traffic-related data to transmit to a remote computing system for further processing, etc.), instance-based methods (e.g., nearest neighbor, etc.), regularization methods (e.g., ridge regression, etc.), Bayesian methods, kernel methods, supervised learning, semi-supervised learning, unsupervised learning, reinforcement learning, and/or any other suitable approach.

Block S130 can include determining any number of traffic-related events using any number (e.g., including zero) of traffic event models, based on any suitable number and types of datasets collected from any suitable number and types of data collection components. Traffic event models are preferably machine-trained classification models that classify a plurality of signal inputs as corresponding to a traffic-related event of a particular type or class, with associated properties; however, the traffic event models can additionally or alternatively be any other suitable type of model (e.g., a deterministic model, a functional model, an empirical model, a reduced-order model, etc.). In examples, the traffic event models can accept as inputs signals such as obtained from or collected at: inertial measurement units (IMU), speed sensors (e.g., GPS sensors that output a time series of locations), impact sensors, cameras, audio sensors (e.g., that output dB levels, power-frequency distributions, etc.), pressure sensors (e.g., to monitor for airbag deployment), and any other suitable sensors. In some variations, the traffic event model can be partially or entirely executed at the first device and the traffic event can thus be determined prior to transmission to the network (e.g., via an intermediate device); in alternative variations, the traffic event can be determined at an intermediate device subsequent to transmission of the unprocessed or partially processed data from the first device.

Block S130 can include training (e.g., updating) one or more traffic event models. Training is preferably performed based on labeled data (e.g., labeled observations), which can be generated during implementation of the method 100 in real-world situations. Training can include updating the traffic event model based on labeled observations of model performance. Additionally or alternatively, training can be performed based on unlabeled data (e.g., unsupervised learning). The performance of the traffic event models can be evaluated by comparing the received traffic-related communication to the occurrence of a traffic-related event determined at the receiving device (e.g., by collecting a movement dataset corresponding to a location sensor and/or a motion sensor of the receiving device, wherein the movement dataset is associated with PVA of the vehicle associated with the receiving device, and determining a traffic-related event based on the movement dataset and comparing the traffic-related event with the traffic-related communication). For example, if the received traffic-related communication indicates that a hard-braking event has occurred ahead of the receiving vehicle, Block S130 can include generating a labeled observation as to whether a hard braking event in fact occurred based on a movement dataset collected by the receiving device (e.g., processed at the device to determine the traffic-related event, transmitted to an intermediate device wherein the traffic event model is executed and processed at the intermediate device, etc.). In a related example, wherein the received traffic-related communication indicates the presence of a pothole or road debris ahead of the receiving vehicle, Block S130 can include detecting whether the driver input a steering command to avoid the pothole or road debris and generating a labeled observation based on detecting such an input. Block S130 can additionally or alternatively include generating labeled observations based upon a generated control instruction. Labeled observations can include observations of false positives in traffic-related communications; for example, upon receiving the traffic-related communication at a device (e.g., a device determined to be within a region of interest of a traffic-related event), Block S130 can include generating a labeled observation indicative that the traffic-related communication is irrelevant to the receiving vehicle (e.g., based on a movement dataset collected at the device) and updating the traffic-event model based on the labeled observation.

In an example, Block S130 can include determining a traffic-related event by processing movement datasets (e.g., with a traffic event model) collected from a first vehicle, a second vehicle, and smartphones residing in the vehicles, on audio data collected from a microphone mounted to a stop light at an intersection proximal the vehicles, on optical data from a smartphone of a pedestrian proximal the intersection (e.g., collected through a social media post of the pedestrian), on traffic data (e.g., collected from a third party) indicating traffic data proximal the intersection, on weather data (e.g., collected from a third party) indicating weather conditions proximal the intersection, and/or on any other suitable combination of data, where such data can be received and/or processed at a central remote computing system and/or other suitable components. In another example, Block S130 can include determining a traffic-related event based on movement data and supplementary data collected at the same data collection component.

Block S130 is preferably performed at one or more remote computing systems (e.g., remote server systems, telecommunication entities such as cellular towers, network infrastructure components defining a fixed geographic location, etc.). Additionally or alternatively, portions of Block S130 can be performed by data collection components, other devices, and/or any suitable components. In an example, extracting a set of movement features can include allocating the feature extraction and/or other suitable pre-processing to the data collection components, such as prior to transmission to a remote computing system, which can reduce latency (e.g., by distributing processing functionality across a plurality of components, etc.) associated with traffic-related event determination and response. In another example, Block S130 can include storing and/or executing traffic event models at a device (e.g., vehicle, smartphone, etc.), at a remote computing system, and/or any suitable component, where the traffic event models can additionally or alternatively be generated (e.g., trained, updated) at any suitable component. However, functionality associated with Block S130 (and/or other portions of the method 100) can be distributed across any suitable components in any suitable manner.

Block S130 is preferably performed in real-time during and/or immediately after a vehicular accident (e.g., during an accident monitoring mode triggered by satisfaction of a movement characteristic condition; etc.) but can additionally or alternatively be performed prior to a vehicular accident. However, traffic-related events can be associated with, for, and/or otherwise related to any suitable temporal indicator (e.g., traffic-related events describing historic vehicular accidents, current vehicular accidents such as in real-time, future potential vehicular accidents such as for facilitating vehicular accident prevention through tailored driving recommendations suitable for avoiding potential vehicular accidents associated with the driving session; etc.).

Block S130 can include predicting a traffic-related event (e.g., a near-miss, a near-collision, etc.) based on movement data and/or supplementary data. Characteristics of the predicted event can determine the relevant devices for notification, such as whether devices ahead of the primary device (e.g., the device collecting the datasets used for event determination) or behind the primary device are likely to be affected by the event. For example, Block S130 can include determining that a vehicle is passing the host vehicle (e.g., the vehicle in which the detecting or transmitting device is located) at high speed (e.g., via a camera of the device) and/or driving recklessly (e.g., weaving in and out of traffic), and thus relevant and/or affected users or devices can be located ahead of the vehicle in which the detecting device is located (e.g., in contrast to vehicles behind the first device).

Additionally or alternatively, Block S130 and/or other suitable portions of the method 100 can be performed in any manner analogous to that described U.S. application Ser. No. 15/584,375 filed 2 May 2017, which is incorporated herein in its entirety by this reference. However, Block S130 can be performed in any suitable manner.

3.4 Transmitting Traffic-Related Communications to a Second Device.

As shown in FIGS. 1-2, Block S140 can include transmitting a traffic-related communication from the remote computing system to a second device associated with a second user in response to determining the traffic-related event. S140 can function to inform users of traffic-related information (e.g., derived from the determined traffic-related event; derived in response to determination of the traffic-related event, etc.) and/or initiate traffic-related actions.

Figure 3:
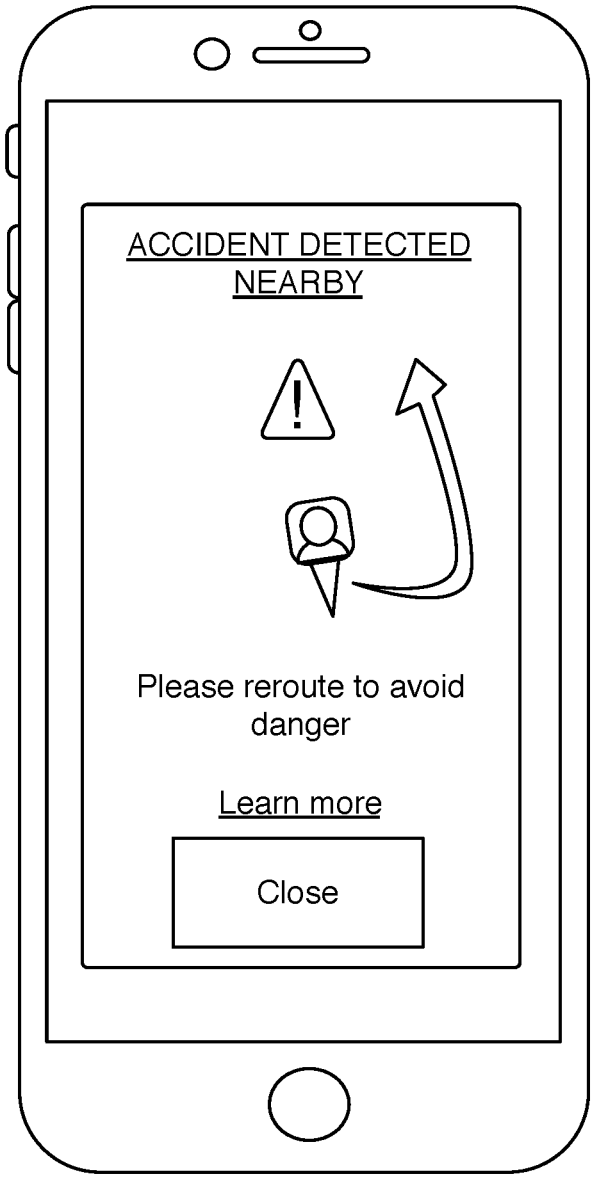
FIG. 3 is a specific example of a traffic-related communication.
Figure 4:
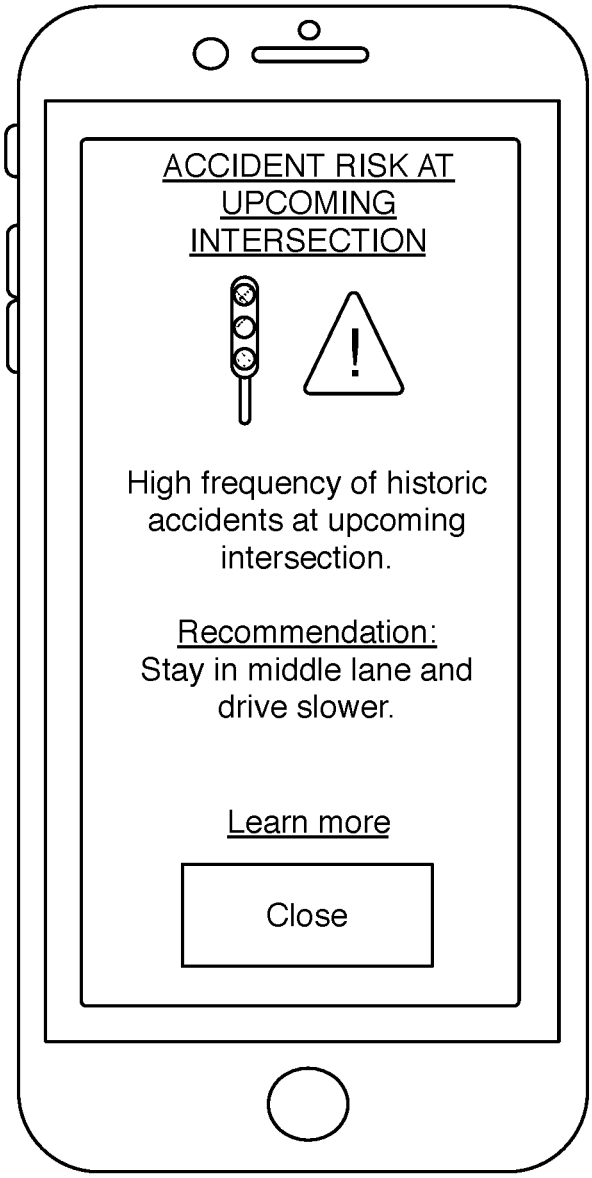
FIG. 4 is a specific example of a traffic-related communication.

Transmitting traffic-related communications can include presenting a traffic-related notification (e.g., as shown in FIGS. 3-4), contacting emergency services, facilitating insurance processing, facilitating communication with a virtual assistant, communicating with a user device (e.g., smartphone, vehicle, etc.), and/or any other suitable processes.

In a variation, transmitting an traffic-related communication to a second device can include controlling and/or transmitting communications to a vehicle (e.g., an autonomous vehicle associated with any suitable levels of autonomous driving; etc.), such as through re-routing vehicles (e.g., to avoid observed vehicular accidents; to avoid potential vehicular accidents; to avoid traffic associated with vehicular accidents; changing lanes; performing any suitable action related to vehicular path-associated components; etc.) and/or through other suitable processes. In another variation, transmitting traffic-related communications can include transmitting notifications including traffic-related information (e.g., for presentation at the mobile device, vehicle, through augmented reality at smartglasses, etc.). For example, driving recommendations can be transmitted to a vehicle for display at a vehicle interface. In another variation, transmitting a traffic-related communication to a second device can include insurance processing (e.g., pre-filling insurance forms with data extracted through portions of the method 100; transmitting risk-associated traffic-related information to insurance entities; etc.).

Regarding Block S140, transmitting traffic-related communications is preferably based on determined traffic-related events (e.g., presence of, location, associated movement characteristics, associated supplementary data, severity, type, area of effect, users implicated, devices implicated, time, environmental conditions, user preferences, other traffic-related information, etc.). In an example, traffic-related communications, including traffic-related information such as severity and/or vehicular accident location and/or routing, can be transmitted to emergency services (e.g., who can leverage the traffic-related information to provide services tailored to the characteristics of the vehicular accident, etc.). In another example, traffic-related communications can be transmitted to devices in vehicles that are moving towards a region in which a traffic-related event has occurred (e.g., based on data indicative that a first vehicle that has turned around the corner of an intersection has come to an abrupt stop, notifying a second vehicle that is turning the corner based on data received from a navigation system of a device in the second vehicle indicating that the second vehicle is turning the same corner imminently). Additionally or alternatively, traffic-related communication can be transmitted based on movement datasets, supplementary datasets, features (e.g., movement features, supplementary features, etc.), accident characteristics (e.g., determined in Block S130 for traffic-related events, etc.), user preferences (e.g., preferred type and/or number of traffic-related communications; preferences received at an application executing on the mobile computing device, etc.), and/or any other suitable data.

Block S140 can include determining a set of vehicles and/or secondary devices (e.g., corresponding to users, vehicles, etc.) to which traffic-related communications are transmitted. In variations, this can include relaying traffic-related communications to devices corresponding to vehicles in a region of interest around the traffic-related event (e.g., the potential impact zone surrounding a collision event, the slowdown zone behind an abrupt stop, etc.). This set can be determined dynamically (e.g., updated in real time or near-real time based on which devices are proximal to the primary device or intermediate device at a given point in time, based on a dynamically determined region of interest associated with the traffic-related event and/or its properties, etc.), statically based on the properties of the transmitting device (e.g., a geographic radius around the intermediate device which can be fixed if the intermediate device defines a fixed geographic location or mobile if the intermediate device is a mobile device, a fixed region of interest based on the transmitting device and/or its properties such as transmission range, etc.), or otherwise suitably determined. Determining the set of devices can include determining a region of interest based on characteristics of the traffic-related event and transmitting a traffic-related communication to the set of devices within the region of interest. Determining the set of vehicles can be based on a fuzzy criterion, wherein further determination of the salience of the traffic-related communication to individual devices and/or vehicles is performed at the devices themselves (e.g., the remote computing system can determine that vehicles within about one kilometer should be notified with a traffic-related communication based on the traffic-related event data, and the secondary devices that meet this criterion can subsequently determine whether to generate an output related to vehicle control in response based upon direction of travel, a more precise radius from the first device or intermediate device, etc.).

In some variations, the intermediate device can be associated with a geographic location and maintain a connection with devices within a predetermined radius of the geographic location (e.g., region of interest) to act as a relay for receiving datasets (e.g., movement datasets, supplementary datasets, etc.), determining traffic-related events at the intermediate device, and communicating traffic-related communications to devices within the predetermined radius. Devices can create, maintain, and/or break the connection with the intermediate device as they enter, remain within, and/or exit the region of interest, respectively. The geographic location can be fixed (e.g., wherein the intermediate device is a network infrastructure node at a fixed location) or mobile (e.g., wherein the intermediate device is a relay device among other similar devices acting as a component of a mesh network). The region of interest can be determined based on the movement dataset (e.g., the speed of the first vehicle, the location of the first vehicle, etc.) and/or the supplementary dataset (e.g., traffic data proximal the first vehicle, traffic conditions in the vicinity of the first vehicle, other supplementary data, etc.).

In a variation, transmitting a traffic-related communication to additional devices can be based on location conditions. For example, the same or different traffic-related communications can be communicated to a plurality of devices within a radius and/or other suitable region of the vehicular of the vehicular accident. In a specific example, the method 100 can include: determining location coordinates corresponding to the traffic-related event; identifying devices within a predetermined distance from the location coordinates (e.g., based on location data collected at GPS sensors of the devices); and transmitting traffic-related communications (e.g., warnings, recommendations, traffic-related information, etc.). The sets of devices to which traffic-related communications are transmitted can dynamically change over time (e.g., as different associated vehicles enter and/or exit the specified region associated with eligibility for receiving the traffic-related communications, etc.).

In another variation, transmitting a traffic-related communication to a second device can be based on temporal conditions. For example, Block S140 can include continuously (e.g., at predetermined time intervals) transmitting traffic-related communications to additional devices for a threshold time after the vehicular accident or other traffic-related event. Additionally or alternatively, transmitting traffic-related communications can be based on any suitable data.

Block S140 preferably includes transmitting traffic-related communications from one or more remote computing systems (e.g., remote server systems; telecommunications entities; etc.) to one or more devices (e.g., data collection components contributing datasets used in determining the traffic-related event; other devices; etc.). In a variation, transmitting a traffic-related communication to a second device can include direct communications between devices (e.g., without an intermediary remote computing system). For example, as shown in FIG. 2, Block S140 can include transmitting traffic-related communications from a first vehicle and/or first mobile device (e.g., smartphone, tablet, etc.) to a second vehicle and/or second mobile device. In a specific example, collection of traffic-related datasets, determination of a traffic-related event, and initiation of a traffic-related event can be performed at a single device (e.g., a smartphone residing within a vehicle; the vehicle itself; etc.). However, traffic-related communications can be transmitted from any suitable number and/or type of components (e.g., devices, remote computing systems, etc.) to any other suitable number and/or type of components.

Block S140 preferably includes transmitting traffic-related communications in response to detecting a traffic-related event, but can additionally or alternatively include transmitting traffic-related communications at predetermined time intervals; in temporal relation to other trigger events (e.g., accident severity satisfying a threshold condition; another traffic-related event and/or associated traffic-related information satisfying a threshold condition; etc.) and/or at any other suitable time. Additionally or alternatively, transmitting traffic-related communications and/or performing other traffic-related actions can be analogous to that described in U.S. application Ser. No. 15/584,375 filed 2 May 2017, which is incorporated in its entirety by this reference. However, Block S140 can be performed in any suitable manner.

3.5 Generating an Output Related to Vehicle Control.

The method 100 can optionally include generating an output related to vehicle control based on the traffic-related communication S150. Block S150 functions to utilize the traffic-related communication at the receiving device to influence the operation of the vehicle in which the receiving device is located. Block S150 can also function to alert a driver to the occurrence of the traffic-related event, and to suggest a course of action to the driver in response to the traffic-related event. Block S150 can also function to automatically execute a control action based on the output (e.g., wherein the output includes control instructions) in cases wherein the vehicle is at least partially controllable by a computing system. Block S150 can also function to determine the saliency of the received traffic-related communication to the receiving device (e.g., and/or the associated vehicle) and generate the output (e.g., which can include taking no action, logging a labeled observation indicative of a false positive, or other suitable output that is not surfaced to the vehicle or driver) based on the saliency (e.g., which can be quantified by a saliency score or metric that is compared to a threshold value to determine whether or not to surface the output to the driver).

In relation to Block S150, the output can be generated by the receiving device itself (e.g., using a traffic event response model executing at the receiving device, using a vehicle control model executing at the receiving device, using a list of predetermined alert messages stored at the receiving device, etc.). Additionally or alternatively, the output can be generated at the intermediate device (e.g., the remote computing system, another mobile device, etc.) and transmitted to the receiving device for provision to the vehicle (e.g., as an executable control instruction) and/or driver (e.g., as a warning, alert, message, etc.).

In variations, Block S150 can include generating an output that includes a notification provided to the driver at a user interface of the receiving device (e.g., secondary device, second device, etc.). For example, the output can include an audio message that notifies the driver that they should slow the vehicle (e.g., a beep noise known by the driver to indicate a warning to brake, a voice message that states the word "brake", etc.).

Block S150 can include determining that the traffic-related communication is relevant based on locally-sourced data (e.g., a movement dataset and/or supplementary dataset collected at the receiving device or device proximal the receiving device). For example, Block S150 can include providing an alert to the driver of the vehicle in which the receiving device is located at an output of the receiving device in response to determining, at the receiving device based on a location of the receiving device, that the receiving device is located within the region of interest (e.g., wherein the region of interest is known and/or transmitted from the intermediate device as a component of the traffic-related communication). In such examples, the method 100 can include transmitting a traffic-related communication to a set of secondary devices (e.g., 100 devices within transmission range of the intermediate device) and generating an output at a subset of the set of secondary devices (e.g., 5 devices of the 100 that are located behind the first vehicle or first device and travelling in the same direction, and thus are determined to be affected by an abrupt stop of the first vehicle). In a related example, Block S150 can include providing an alert to the user of the receiving device at an output of the receiving device in response to determining, at the receiving device based on a navigation module of the receiving device, that a planned route of receiving device (e.g., of the vehicle in which it is located) intersects a region of interest (e.g., computed at the receiving device based on the traffic-related communication).

In relation to Block S150, the output can include control instructions. Control instructions can be driver-executable instructions (e.g., natural language instructions, intuitive implied instructions, abstract instructions known by the driver to correspond to specific control actions, etc.) and/or computing system-executable instructions (e.g., analog or digital commands, inputs for robotic actuators linked to vehicle control interfaces, etc.). In an example, Block S150 includes providing the control instruction to a driver of a second vehicle (e.g., in which a receiving device is located) at a user interface of the receiving device. In another example wherein the method includes receiving the traffic-related communication at a second device of a set of secondary devices within a region of interest and collecting a movement dataset corresponding to at least one of a location sensor and a motion sensor of the second device (e.g., associated with PVA of the second vehicle), Block S150 can include generating a control instruction associated with the second vehicle based on the movement dataset. In a related example, Block S150 can include automatically controlling the second vehicle based on the control instruction.

In another example wherein the traffic-related communication is indicative of a hard-braking event associated with a first vehicle (e.g., in which a first device is located, and the first device transmits a movement dataset to an intermediate device that determines the traffic-related communication), Block S150 can include generating the control instruction by determining, at a second device in a second vehicle, that the second vehicle is within a predetermined distance of a rear bumper of the first vehicle based on a movement dataset collected at the second vehicle and generating a control instruction that includes an instruction to slow the second vehicle.

In a related example wherein the traffic-related communication is indicative of a high risk driving event associated with the first vehicle, Block S150 can include generating the control instruction by determining, at the second device, that a planned route of the second vehicle is proximal an estimated route the first vehicle based on the movement dataset and generating a control instruction including an instruction to modify the planned route of the second vehicle to increase the relative distance between the planned route and the estimated route.

However, Block S150 can additionally or alternatively include generating any suitable output related to vehicle control in any other suitable manner based on the traffic-related communication and/or any other suitable data.

3.6 Additional Specific Examples.

Figure 5:
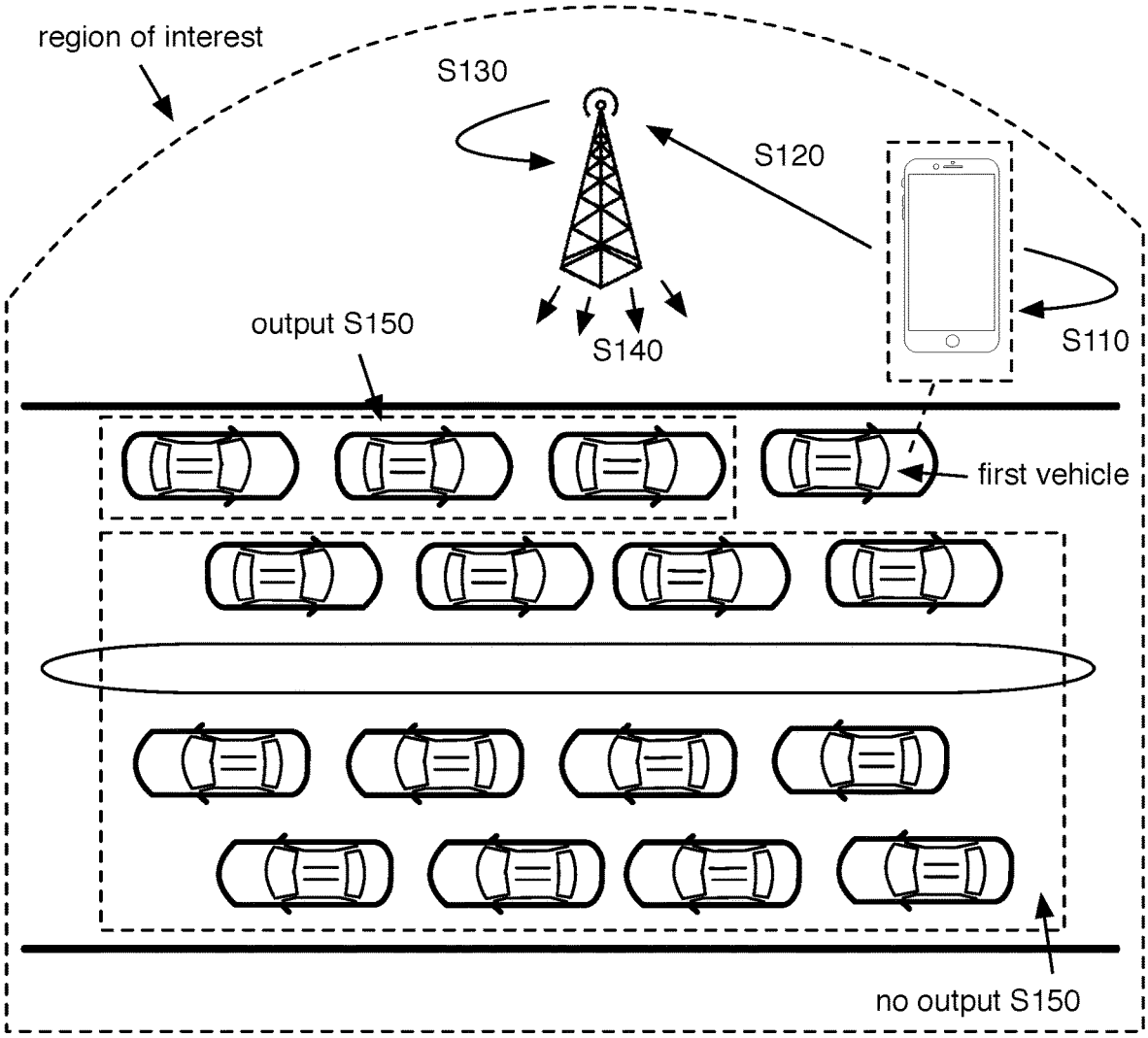
FIG. 5 is a schematic representation of a specific implementation of the method for inter-vehicle traffic-related communication.

In a specific example, as shown in FIG. 5, the method includes determining that a first vehicle has applied the brakes (e.g., in accordance with one or more variations of Block S110, S120, and S130) and transmitting a notification to all devices corresponding to vehicles within one mile of the first vehicle (e.g., in accordance with one or more variations of Block S140) and, at a subset of those devices, generating an advance warning (e.g., in accordance with one or more variations of Block S150) and providing the advance warning to drivers of the vehicles in which the subset of those devices are located. In this example, each device that receives the notification determines whether to generate the advance warning based on the relative location (e.g., whether the devices are within a threshold distance less than one mile such as 200 meters, 400 meters, etc.; whether the devices are ahead of or behind the first vehicle; etc.) in combination with the direction of travel of the device (e.g., whether the device is behind the first vehicle and travelling the same direction or not). However, in related examples, the receiving devices can otherwise suitably determine whether or not to generate an output in any other suitable manner.

In another specific example, the method includes: collecting a first movement dataset corresponding to at least one of a location sensor and a motion sensor of a first device arranged within a first vehicle, wherein the first movement dataset is associated with position, velocity, and acceleration (PVA) of the first vehicle (e.g., in accordance with Block S110); collecting a supplementary dataset from the first device, wherein the first device is associated with a first user (e.g., in accordance with Block S110); transmitting the movement dataset and supplementary dataset from the first device to a remote computing system (e.g., in accordance with Block S120); determining, at the remote computing system, a traffic-related event based upon processing the movement dataset and supplementary dataset with a traffic event model (e.g., in accordance with Block S130); and in response to determining the traffic-related event, transmitting a traffic-related communication from the remote computing system to a second device associated with a second user arranged in a second vehicle (e.g., in accordance with Block S40).

In another specific example, the method includes: collecting a first movement dataset corresponding to at least one of a first location sensor and a first motion sensor of a first device arranged within a first vehicle, wherein the movement dataset is associated with position, velocity, and acceleration (PVA) of the first vehicle (e.g., in accordance with Block S110); collecting a supplementary dataset from the first device, wherein the first device is associated with a first user (e.g., in accordance with Block S110); transmitting the movement dataset and supplementary dataset from the first device to an intermediate device (e.g., in accordance with Block S120); determining, at the intermediate device, a traffic-related event based upon processing the movement dataset and supplementary dataset with a traffic event model (e.g., in accordance with Block S130); determining, at the intermediate device, a region of interest based on the traffic-related event (e.g., in accordance with Block S130); and transmitting a traffic-related communication to a set of secondary devices within the region of interest, wherein each of the set of secondary devices is associated with a corresponding user (e.g., in accordance with Block S140).

Although omitted for conciseness, the preferred embodiments include every combination and permutation of the various system components and the various method processes, including any variations, examples, and specific examples, where the method processes can be performed in any suitable order, sequentially or concurrently. The system and method and variations thereof can be embodied and/or implemented at least in part as a machine configured to receive a computer-readable medium storing computer-readable instructions. The instructions are preferably executed by computer-executable components preferably integrated with the system. The computer-readable medium can be stored on any suitable computer-readable media such as RAMs, ROMs, flash memory, EEPROMs, optical devices (CD or DVD), hard drives, floppy drives, or any suitable device. The computer-executable component is preferably a general or application specific processor, but any suitable dedicated hardware or hardware/firmware combination device can alternatively or additionally execute the instructions. As a person skilled in the art will recognize from the previous detailed description and from the figures and claims, modifications and changes can be made to the preferred embodiments of the invention without departing from the scope of this invention defined in the following claims.

We claim:

1. A method for improving vehicular traffic-related communications between devices comprising:

collecting a first movement dataset corresponding to at least one of a location sensor and a motion sensor of a first device arranged within a first vehicle, wherein the first movement dataset is associated with position, velocity, and acceleration (PVA) of the first vehicle;

collecting a supplementary dataset from the first device, wherein the first device is associated with a first user;

transmitting the movement dataset and supplementary dataset from the first device to a remote computing system;

determining, at the remote computing system, a traffic-related event based upon processing the movement dataset and supplementary dataset with a traffic event model;

dynamically determining, at the remote computing system, a mobile region of interest based on the supplementary data and the movement dataset, wherein the region of interest contains the first device; and in response to determining the traffic-related event, transmitting a traffic-related communication from the remote computing system to a second device associated with a second user arranged in a second vehicle.

2. The method of claim 1, wherein the supplementary dataset comprises traffic congestion data associated with a geographic location of the first vehicle.

3. The method of claim 2, further comprising transmitting the first movement dataset to remote computing system in response to an acceleration of the first vehicle exceeding a threshold, wherein the threshold is dynamically computed in real-time at the first device based on a velocity of the first vehicle and the traffic data.

4. The method of claim 1, further comprising collecting a second movement dataset corresponding to at least one of a second location sensor and a second motion sensor of the second device, wherein the second movement dataset is associated with PVA of the second vehicle, and generating a labeled observation associated with the traffic-related communication based on the second movement dataset.

5. The method of claim 4, further comprising updating the traffic event model based on the labeled observation.

6. The method of claim 1, wherein the remote computing system comprises a network infrastructure component defining a fixed geographic location, wherein the network infrastructure component executes the traffic event model, and wherein the second device is located within a predetermined range of the fixed geographic location.

7. The method of claim 1, wherein the traffic-related communication includes the region of interest.

8. The method of claim 7, further comprising providing an alert to the second user at an output of the second device in response to determining, at the second device, that the second device is located within the region of interest.

9. The method of claim 7, further comprising providing an alert to the second user at an output of the second device in response to determining, at the second device, that a planned route of the second vehicle intersects the region of interest.

10. A method for improving vehicular traffic-related communications between devices comprising:

collecting a first movement dataset corresponding to at least one of a first location sensor and a first motion sensor of a first device arranged within a first vehicle, wherein the movement dataset is associated with position, velocity, and acceleration (PVA) of the first vehicle;

collecting a supplementary dataset from the first device, wherein the first device is associated with a first user;

transmitting the movement dataset and supplementary dataset from the first device to an intermediate device;

determining, at the intermediate device, a traffic-related event based upon processing the movement dataset and supplementary dataset with a traffic event model;

dynamically determining, at the intermediate device, a mobile region of interest based on the traffic-related event, wherein the region of interest contains the first device;

transmitting a traffic-related communication to a set of secondary devices within the region of interest, wherein each of the set of secondary devices is associated with a corresponding user.

11. The method of claim 10, wherein the intermediate device comprises a second device associated with a second user arranged in a second vehicle located within a predetermined range of the first vehicle.

12. The method of claim 10, wherein the intermediate device comprises a network infrastructure component defining a fixed geographic location within a predetermined range of the first vehicle, wherein the network infrastructure component executes the traffic event model.

13. The method of claim 10, further comprising:

receiving the traffic-related communication at a second device of the set of secondary devices within the region of interest, wherein the second device is arranged in a second vehicle;

in response to receiving the traffic-related communication, collecting a second movement dataset corresponding to at least one of a second location sensor and a second motion sensor of the second device, wherein the movement dataset is associated with PVA of the second vehicle; and generating a control instruction associated with the second vehicle based on the second movement dataset.

14. The method of claim 13, further comprising generating a labeled observation based on the control instruction and updating the traffic-event model based on the labeled observation.

15. The method of claim 13, further comprising providing the control instruction to a driver of the second vehicle at a user interface of the second device.

16. The method of claim 13, further comprising automatically controlling the second vehicle based on the control instruction.

17. The method of claim 13, wherein the traffic-related communication is indicative of a hard-braking event associated with the first vehicle and wherein generating the control instruction comprises:

determining, at the second device, that the second vehicle is within a predetermined distance of a rear bumper of the first vehicle based on the movement dataset;

generating the control instruction comprising an instruction to slow the second vehicle.

18. The method of claim 13, wherein the traffic-related communication is indicative of a high-risk driving event associated with the first vehicle and wherein generating the control instruction comprises:

determining, at the second device, that a planned route of the second vehicle is proximal an estimated route of the first vehicle based on the movement dataset; and generating the control instruction comprising an instruction to modify the planned route of the second vehicle to increase the relative distance between the planned route and the estimated route.

19. The method of claim 10, further comprising:

receiving the traffic-related communication at a second device of the set of secondary devices within the region of interest, wherein the second device is arranged in a second vehicle;

collecting a second movement dataset corresponding to at least one of a second location sensor and a second motion sensor of the second device, wherein the second movement dataset is associated with PVA of the second vehicle;

generating a labeled observation indicative that the traffic-related communication is irrelevant to the second vehicle based on the second movement dataset; and updating the traffic-event model based on the labeled observation.

* * * * *